US006244730B1

(12) United States Patent
Goldberg et al.

(10) Patent No.: US 6,244,730 B1
(45) Date of Patent: Jun. 12, 2001

(54) LIGHT SOURCE WITH EASILY ACCESSED LIGHT GUIDE

(75) Inventors: Richard D. Goldberg, Hartford; Rupert O. Yantz, West Bend, both of WI (US)

(73) Assignee: Phoenix Products Company, Inc., Milwaukee, WI (US)

( * ) Notice: Subject to any disclaimer, the term of this patent is extended or adjusted under 35 U.S.C. 154(b) by 0 days.

(21) Appl. No.: 09/307,232

(22) Filed: May 7, 1999

(51) Int. Cl.[7] ..... F21V 29/00

(52) U.S. Cl. ..... 362/268; 362/368; 362/455; 359/892

(58) Field of Search ..... 362/367, 368, 362/268, 455; 359/892

(56) References Cited

U.S. PATENT DOCUMENTS 4,187,534 * 2/1980 Tichenor et al. ..... 362/268
4,519,020 * 5/1985 Little ..... 362/268
5,951,137 * 9/1999 Bortz ..... 353/96
6,092,914 * 7/2000 Esakoff et al. ..... 362/298

* cited by examiner

*Primary Examiner*—Sandra O'Shea
*Assistant Examiner*—John Anthony Ward
(74) *Attorney, Agent, or Firm*—Foley & Lardner

(57) ABSTRACT

A spotlight assembly is disclosed, including a spotlight energizeable to transmit a beam of light and having a lens frame configured to support a lens, and a cylinder coupled to the lens frame and adapted to receive at least one light guide through an opening in a sidewall of the cylinder. An extender for a spotlight configured to generate a beam of light is also disclosed, the spotlight having a first shell to support a reflector and a lamp and a light emitting opening, and a second shell for enclosing the opening, wherein the second shell has a transparent window through which the light beam is transmitted out of the first shell, the extender including a first shell configured to receive and support a plurality of light guides to be spaced along the light beam inside the first shell, and a mounting bracket affixed to the first shell and couplable to an outer surface of the transparent window, wherein the first shell has at least one opening disposed to receive at least one of said plurality of light guides for insertion into the first shell in a direction substantially perpendicular to the axis of the light beam.

3 Claims, 4 Drawing Sheets

10
14

12
22
20
4
40
64
66
44
26
68(a)
50
56
42(a)
68(b)
42(b)
56
54
68(c)
76
52
70
41
4
58

LIGHT SOURCE WITH EASILY ACCESSED LIGHT GUIDE

FIELD OF THE INVENTION

The present invention relates generally to lighting fixtures such as spotlights and floodlights. It relates more particularly to spotlights having removable light guides.

BACKGROUND OF THE INVENTION

It has long been known to provide sources of artificial light (e.g., spotlights and floodlights) with light guiding devices, or light guides, such as louvers, lenses and color filters. While the term "spotlight" is used consistently below, it shall be understood to be a general reference to include floodlights and other similar light sources as well.

Such light guides are typically supported and positioned within an extender, a generally tubular member configured as an extension of a lens holder projecting outwardly from the region of a lens positioned in front of a lamp. In the past, light guides were generally installed in an extender through an open end of the extender opposite the lamp, preferably by carefully dropping the light guide (which may be, e.g., a delicate glass color filter) into the extender while the extender is vertically disposed, allowing the light guide to rest upon a support device (e.g., a flange or a retaining ring), and securing the light guide in place with a retaining device (e.g., a retaining ring or set of spaced-apart retaining tabs).

Removal of a light guide (e.g., to replace a color filter with another of a differing color) is performed in the reverse order. For spotlights having more than one light guide (e.g., a color filter, a louver for glare control, and a lens), the outermost light guides must first be removed to gain access to an innermost light guide (i.e., the light guide positioned nearest the lamp and farthest from the open end of the extender). Since most spotlights are placed in elevated positions, access to the spotlight for light guide removal or installation may be difficult to begin with, a situation which is greatly exacerbated by difficulties likely in removing and installing large light guides and retaining rings within the interior of an extender, particularly if the spotlight cannot be repositioned with the open end of the extender facing upward so gravity can assist in installation.

It would be advantageous to provide an extender for a spotlight which provides quick and easy access to light guides. It would also be advantageous to provide an extender for a spotlight which allows removal and installation of individual light guides without the need for handling or disturbing other light guides.

SUMMARY OF THE PRESENT INVENTION

The present invention relates to a spotlight assembly, including a spotlight energizeable to transmit a beam of light and having a lens frame configured to support a lens, and a cylinder coupled to the lens frame and adapted to receive at least one light guide through an opening in a sidewall of the cylinder.

The present invention also relates to an extender for a spotlight configured to generate a beam of light, the spotlight having a first shell to support a reflector and a lamp and a light emitting opening, and a second shell for enclosing the opening, wherein the second shell has a transparent window through which the light beam is transmitted out of the first shell, the extender including a first shell configured to receive and support a plurality of light guides to be spaced along the light beam inside the first shell, and a mounting bracket affixed to the first shell and couplable to an outer surface of the transparent window, wherein the first shell has at least one opening disposed to receive at least one of said plurality of light guides for insertion into the first shell in a direction substantially perpendicular to the axis of the light beam.

Other principal features and advantages of the invention will become apparent to those skilled in the art upon review of the following drawings, the detailed description and the appended claims.

Figure 1:
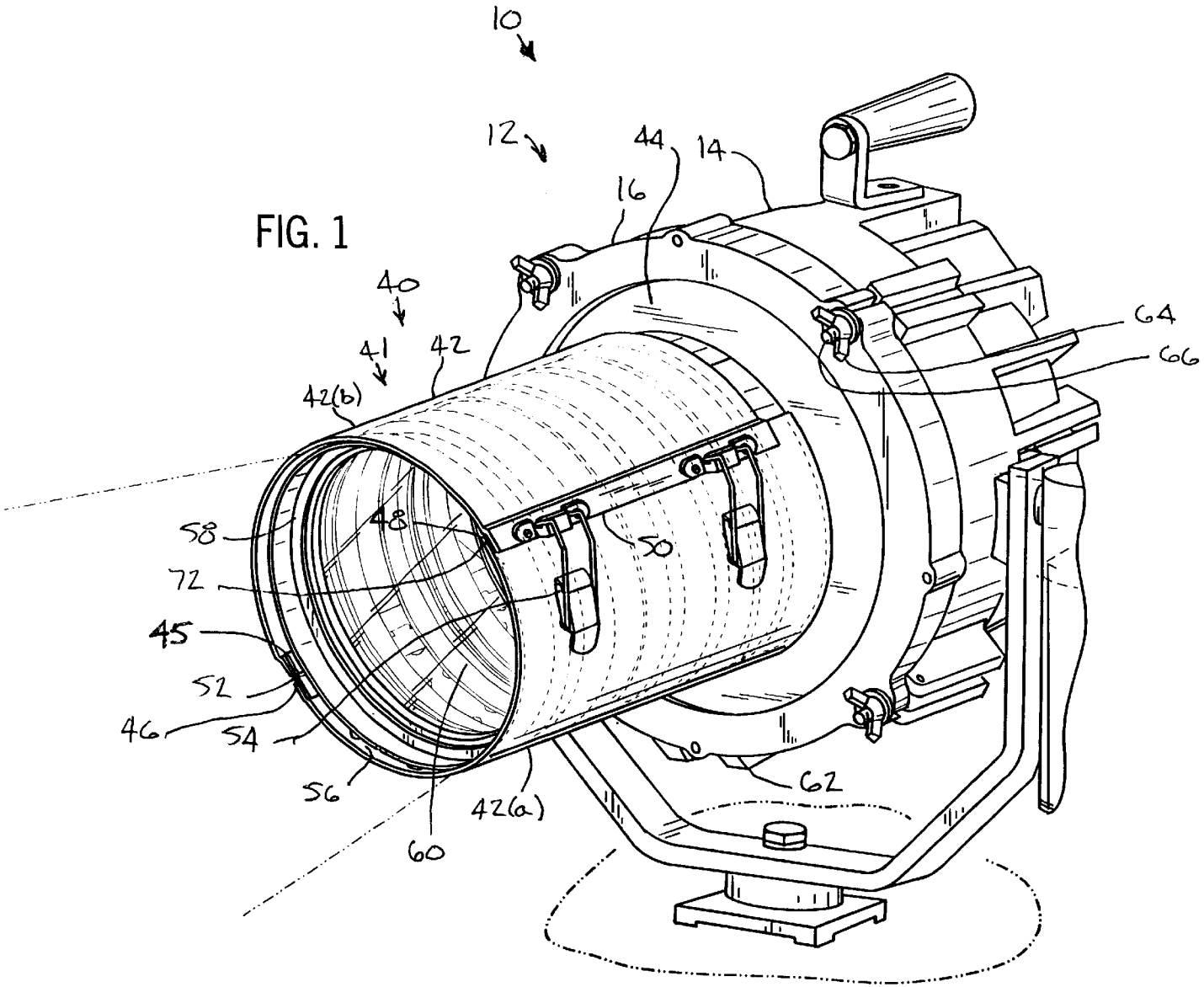
FIG. 1 is a perspective view of a spotlight having a cylinder adapted to receive at least one light guide.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Referring to FIG. 1, which shows a preferred embodiment of a spotlight assembly 10, including a spotlight 12 and a removable extender 40.

The term "spotlight" is used herein to represent a source of artificial light, and it is to be understood that floodlights, sources of collimated light and similar devices are equally within the scope and spirit of the appended claims.

Figure 3:
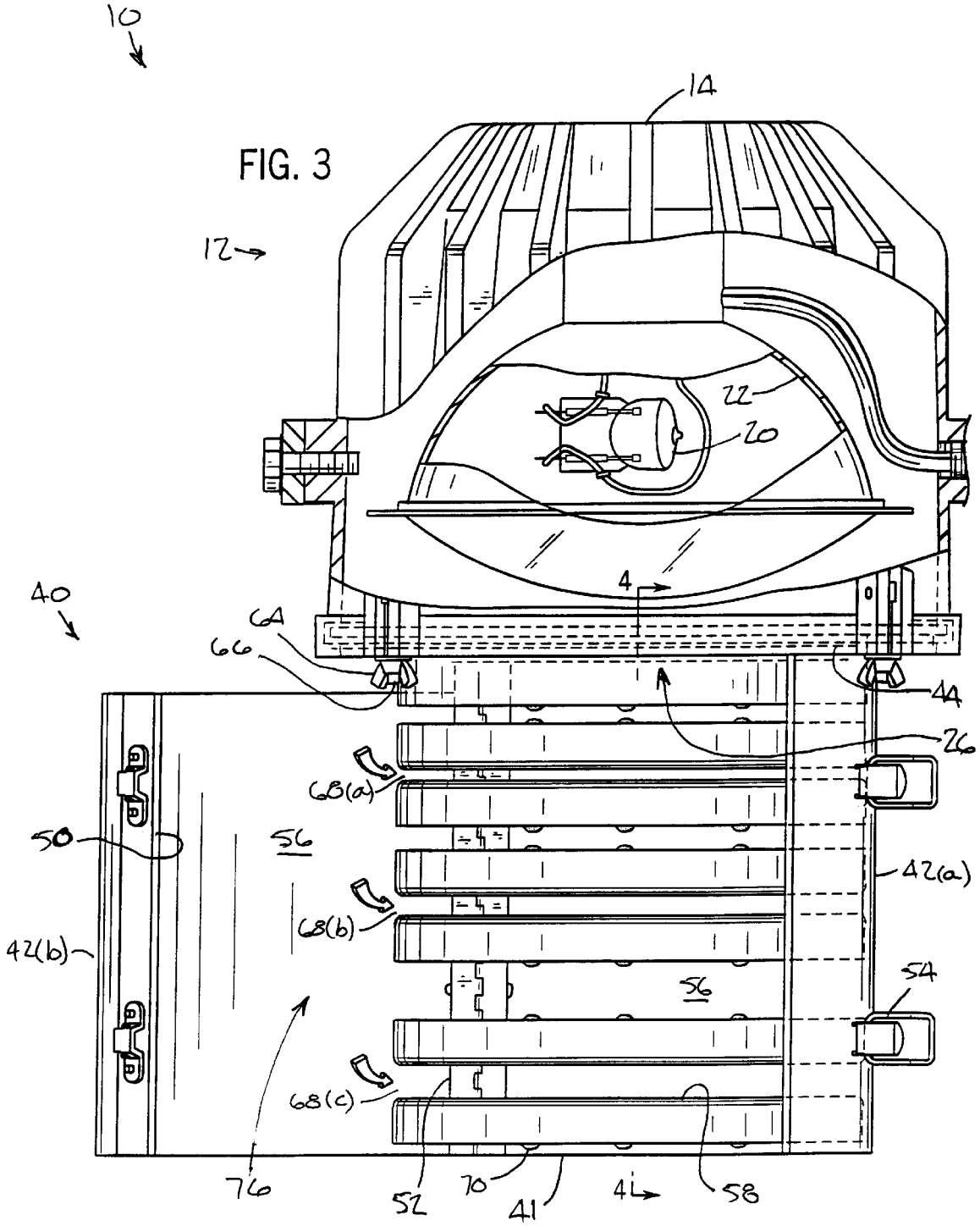
FIG. 3 is a sectional plan view of the spotlight taken at line 3—3 of FIG. 2 and wherein the second shell is opened with respect to the first shell.

Spotlight 12 includes a housing or shell 14, a lens frame or shell 16 having a light emitting opening 26, a light emitting opening cover configured as a transparent window and shown as a lens 18 supported by lens frame 16, a lamp 20 and a reflector 22 (shown in FIG. 3). Lamp 20 is preferably an arc lamp with a range of 25 to 1500 watts. Lens 18 is preferably circular and preferably has a light transmitting area of 16 to 500 square inches. Spotlight 12 may also include a resilient gasket 24 for cushioning and sealing of lens 18 with respect to housing 14 and lens frame 16. Lamp 20 is located between reflector 22 and lens 18 inside housing 14, so that a beam of light generated by lamp 20 may be focused by reflector 22 and transmitted through light emitting opening 26 into, and through, extender 40.

Extender 40 supports and positions one or more light guides 60 (e.g., lenses 60(*a*), color filters 60(*b*), and louvers 60(*c*)), removably coupled to lens frame 16. In a preferred embodiment, extender 40 is configured as a right circular cylinder and includes a cylinder 41 and a mounting bracket 44. Cylinder 41 includes a sidewall 42 having an inner surface 56. Cylinder 41 preferably has a cross-sectional area of 16 to 500 square inches. It is preferably parallel to a central axis 21 of the light beam provided by lamp 20 as focused by reflector 22. Inner surface 56 is preferably finished with a matte black material, to minimize reflection and transmission of stray light. Mounting bracket 44 is shown as a thin, flat flange disposed about the periphery of an end of cylinder 41, in the manner of the brim of a stovepipe hat. Mounting bracket 44 is clamped between lens frame 16 and lens gasket 24 (best seen in FIG. 4), thereby securing extender 40 to spotlight 12. In an alternative embodiment (not shown), an extender is not configured as a right circular cylinder but is provided an a circular cross section; e.g., a polygon, for example a square. In another alternative embodiment (not shown), a mounting bracket is configured as a pattern of tabs peripherally spaced apart. Alternatively, a mounting bracket may be provided to secure extender 40 to an outside surface of lens frame 16.

Spotlight 12 is openable (e.g., for replacement of lamp 20 and for installation and removal of extender 40). In the illustrated instance, lens frame 16 is pivotable about an axis of a hinge 62 with respect to housing 14 after disengaging lens frame locking devices, shown as wing nuts 64 engaged with captive screws 66. When lens frame 16 is pivoted about 90 degrees from its closed (as shown) position with respect to housing 14, lens 18 and a lens gasket 24 (shown in FIG. 4) may be removed, whereupon extender 40 may be installed or removed from lens frame 16.

In a preferred embodiment, sidewall 42 of cylinder 41 includes a first shell 42(*a*) affixed to mounting bracket 44 (e.g., by welding) and a second shell 42(*b*) which is movably affixed to first shell 42(*a*) by a hinge 52 at a first edge 45 of first shell 42(*a*) and at a first edge 46 of second shell 42(*b*). Second shell 42(*b*) is openable with respect to first shell 42(*a*) to form an opening 76 in sidewall 42 for insertion or removal of one or more light guides 60. First shell 42(*a*) functions as a housing for holding supports (shown as rings 58) for light guides 60. Second shell 42(*b*) functions as a cover for first shell 42(*a*). In an alternative embodiment (not shown), a plurality of second shells is provided each of which being individually openable to cover or uncover one or more of the light guides.

Second shell 42(*b*) closes upon first shell 42(*a*) at a second edge 48 of first shell 42(*a*) and a second edge 50 of second shell 42(*b*). One of second edge 48 and second edge 50 is preferably provided with an offset 72, so that it overlaps the other of second edge 48 and second edge 50 and thereby minimizes light leakage at the juncture of second edge 48 and second edge 50. Second edge 50 is secured to second edge 48 by a means for locking second shell 42(*b*) to first shell 42(*a*). In a preferred embodiment, second shell 42(*b*) is locked to first shell 42(*a*) by at least one latch 54 (two are shown). In an alternative embodiment (not shown), the second shell may be locked to the first shell by another type of device; e.g., clamps or threaded fasteners. In another alternative embodiment (not shown), the hinge may be removed and the second shell may be secured to a first shell by locking devices coupling the first edges and locking devices coupling the second edges.

Figure 2:
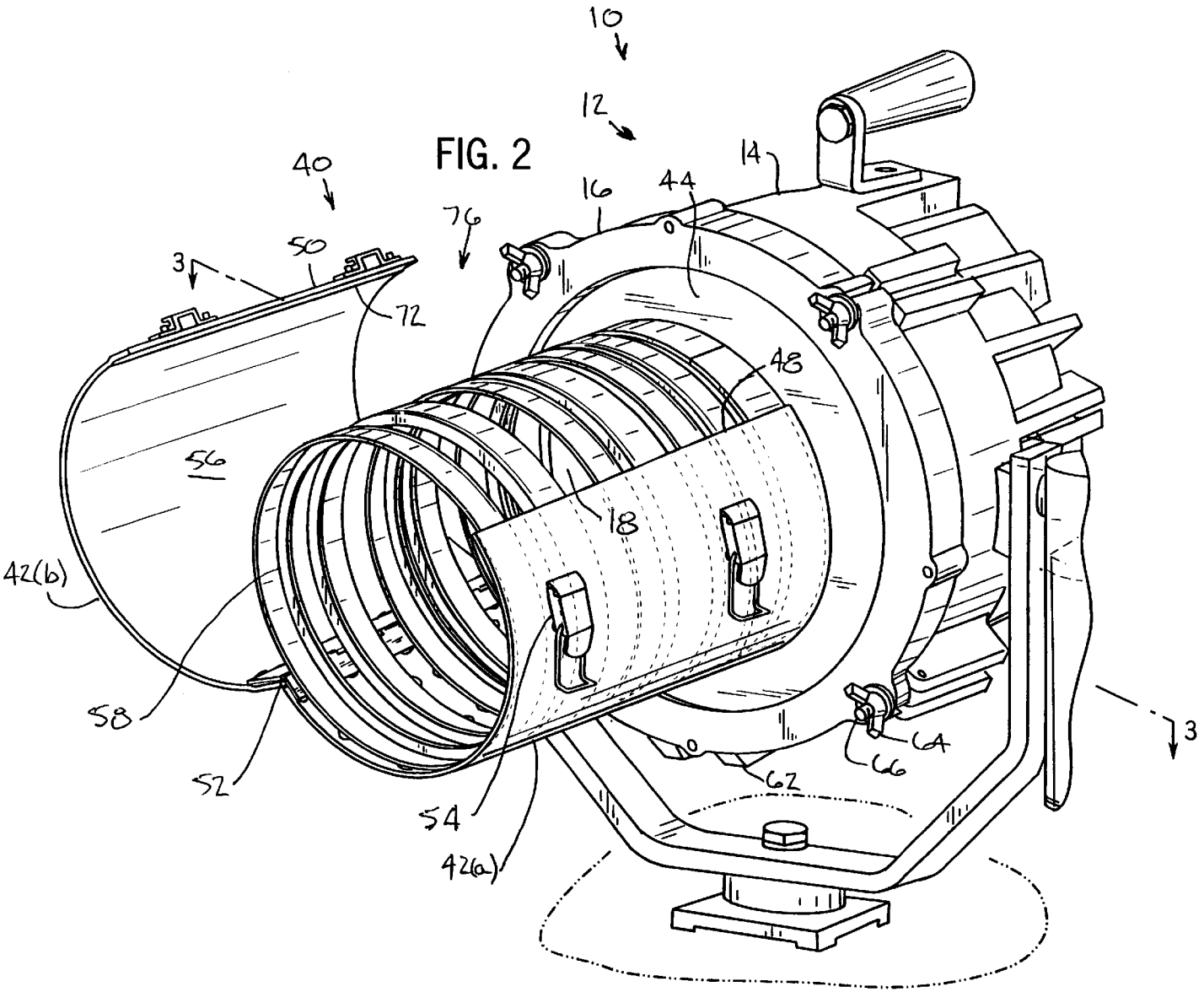
FIG. 2 is a perspective view of the spotlight, wherein a second shell of the cylinder is opened with respect to a first shell.

FIG. 2 shows spotlight assembly 10 having latches 54 disengaged and second shell 42(*b*) pivoted about an axis of hinge 52 and thereby disposed in an opened position with respect to first shell 42(*a*). In a preferred embodiment, a plurality of light guide supports, here shown as rings 58 are affixed to inner surface 56 of sidewall 42 (e.g., by welds 70) at spacings corresponding to thicknesses of light guides 60 to be inserted into extender 40. Two rings 58 are provided per light guide 60, with one ring 58 being disposed to support each side of light guide 60 so that light guide 60 is inserted between a pair of rings 58. A plurality of pairs of rings 58 (three are shown) may be included to accommodate a plurality of light guides.

Rings 58 may be of any suitable configuration, and are illustrated as rolled angles having first flanges abutting, and supporting, opposite sides of light guides 60, and second flanges abutting, and affixed to, inner surface 56. Rings 58 block transmission of stray light; e.g., from an imperfect light guide outside diameter. Rings 58 also assist in supporting second shell 42(*b*) upon first shell 42(*a*). In an alternative embodiment (not shown), light guide supports are configured as a series of tabs peripherally spaced apart.

FIG. 3 shows lamp 20 and reflector 22 located within housing 14, and with lamp 20 disposed between reflector 22 and lens 18 at light emitting opening 26. Second shell 42(*b*) is shown in an opened position with respect to first shell 42(*a*), so that a plurality of spacings 68(*a*), 68(*b*), and 68(*c*) within pairs of rings 58 (in order to accommodate varying thicknesses of light guides 60) may be seen.

Figure 4:
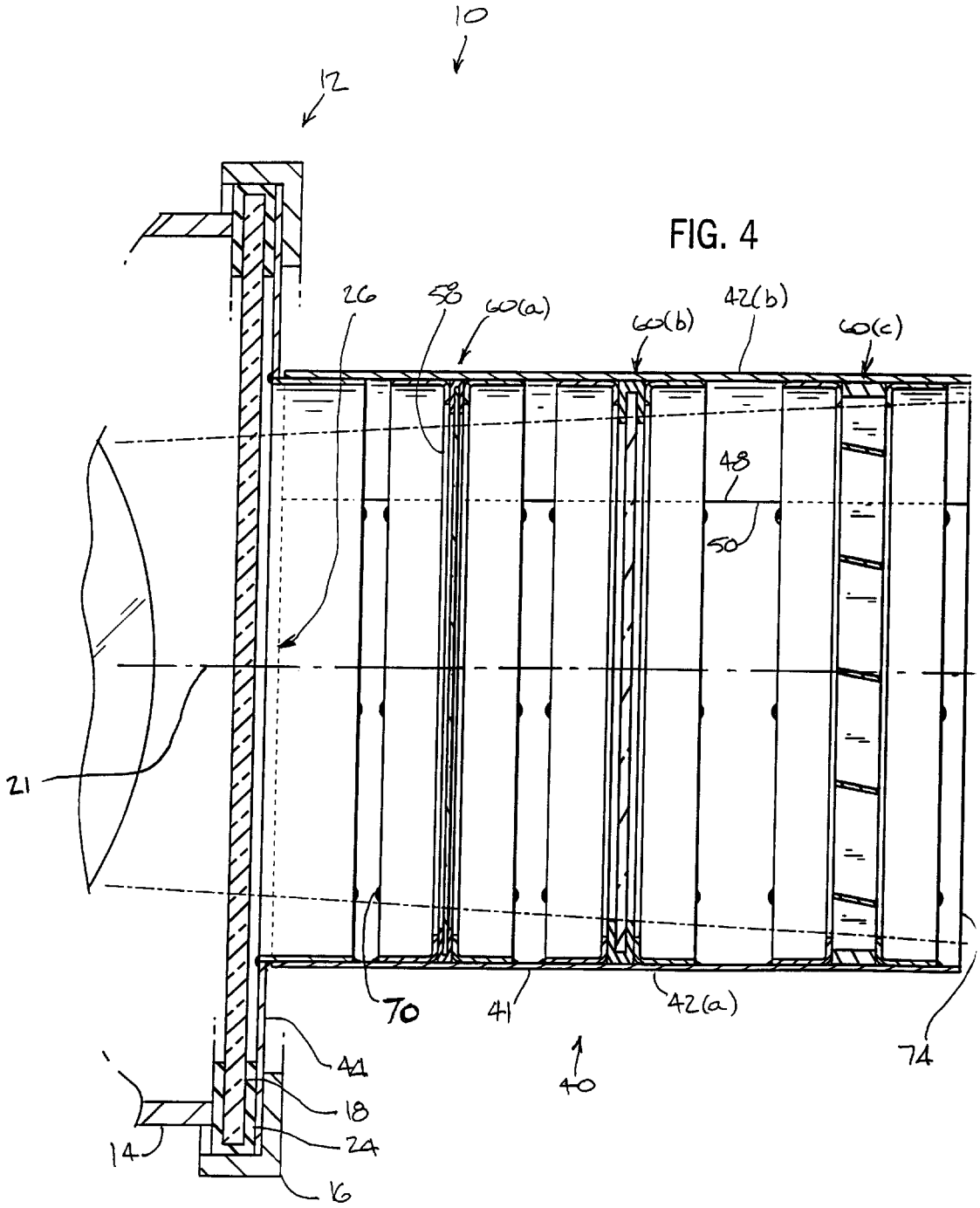
FIG. 4 is a fragmentary sectional side elevation of the spotlight taken at line 4—4 of FIG. 3 and wherein light guides are placed within the cylinder.

FIG. 4 shows light guides 60 of various thicknesses inserted within pairs of rings 58 within extender 40. A lens 60(*a*) is inserted nearest lamp 20 (shown in FIG. 3). A color filter 60(*b*) is inserted adjacent lens 60(*a*), and a louver 60(*c*) is inserted adjacent color filter 60(*b*) and nearest an outer end 74 of extender 40.

While the embodiments illustrated in the Figures and described above are presently preferred, is should be understood that these embodiments are offered only as examples. For further example, an opening in the rear of a lamp housing can allow lamp replacement from the rear and an extender can be secured to a lens frame by, e.g., threaded fasteners. Light guide supports may be provided with biasing means (e.g., springs, belleville washers, elastomeric or plastomeric pads) to allow a snug fit of light guides between the light guide support while inhibiting relative motion due to vibration.

Thus, it should be apparent that there has been provided in accordance with the present invention a light source with easily accessed light guide that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An extender for a spotlight having a central axis, the spotlight having a spotlight shell to support a reflector and a lamp and having a light-emitting opening, a lens frame for enclosing the opening having a transparent window through which a light beam is transmitted out of the spotlight, the extender comprising:

a first elongate, semi-cylindrical shell, at least one pair of circular rings being affixed to the inner surface of the first shell, each ring pair being coaxial with the axis of the first shell and each ring being spaced apart from the other ring in its pair by a distance sufficient to support a circular light guide;

a mounting bracket affixed to the first shell and coupled to the lens frame; and a second semi-cylindrical shell coupled to the first shell, the coupling permitting movement of the second shell with respect to the first shell so that a light guide can be inserted into and/or removed from a ring pair.

2. The extender of claim 1, wherein:

the second shell is hingeably mounted to the first shell along a first edge for opening and closing of the extender; and at least one of the first shell and the second shell includes a locking member disposed along a second edge to hold the second shell in a closed position with respect to the other of the first shell and the second shell.

3. The extender of claim 1, wherein the first shell has a plurality of ring pairs fixed to the inner surface thereof.

* * * * *